US006358366B1

(12) United States Patent
Hongisto et al.

(10) Patent No.: US 6,358,366 B1
(45) Date of Patent: Mar. 19, 2002

(54) SYSTEM AND METHOD FOR THREADING A MOIST WEB IN A PULP DRYER OR THE LIKE FROM ONE SECTION TO THE FOLLOWING SECTION

(75) Inventors: Pertti Hongisto, Kaarina; Paavo Sairanen, Turku; Time Tammekas, Siltakylä ; Raimo Virta, Turku, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/601,261

(22) PCT Filed: Jan. 29, 1999

(86) PCT No.: PCT/FI99/00060

§ 371 Date: Aug. 25, 2000

§ 102(e) Date: Aug. 25, 2000

(87) PCT Pub. No.: WO99/39049

PCT Pub. Date: Aug. 5, 1999

(30) Foreign Application Priority Data

Jan. 30, 1998 (FI) ..... 980212
Jun. 24, 1998 (FI) ..... 981449

(51) Int. Cl.[7] ..... D21F 7/00; D21F 1/36; D21F 3/10

(52) U.S. Cl. ..... 162/193; 162/194; 162/286; 162/363; 34/117; 34/120; 226/7; 226/91; 226/92

(58) Field of Search ..... 162/193–194, 162/202–205, 286, 289, 275, 358.1, 363; 34/114, 117, 120, 122; 83/53, 177, 156, 161; 226/7, 91–92, 97.3–97.4

(56) References Cited

U.S. PATENT DOCUMENTS

| | | | | | |
|---|---|---|---|---|---|
| 3,309,263 | A | * | 3/1967 | Grobe | 162/306 |
| 3,325,351 | A | * | 6/1967 | Orton, Jr. | 162/358.1 |
| 3,355,349 | A | * | 11/1967 | Devlin | 162/286 |
| 3,526,574 | A | | 9/1970 | Beachler et al. | |
| 3,595,745 | A | * | 7/1971 | Cronin | 162/306 |
| 3,598,697 | A | * | 8/1971 | McKie et al. | 162/306 |
| 3,671,389 | A | * | 6/1972 | Wahlstrom et al. | 162/306 |
| 3,756,912 | A | * | 9/1973 | Rooney | 162/255 |

(List continued on next page.)

FOREIGN PATENT DOCUMENTS

| | | |
|---|---|---|
| CA | 972387 | 8/1975 |
| FI | 7603617 | 11/1977 |
| FI | 790860 | 10/1979 |
| FI | 822956 | 4/1983 |
| FI | 860517 | 8/1986 |
| FI | 873146 | 1/1988 |
| FI | 864955 | 6/1988 |
| FI | 8703690 | 2/1989 |
| FI | 935321 | 5/1995 |

*Primary Examiner*—José Fortuna
(74) *Attorney, Agent, or Firm*—Nixon & Vanderhye PC

(57) ABSTRACT

A system and method effectively threading the moist tail of a web through a pulp dryer. A tail threading belt in a closed loop passes the tail of the web through the dryer, and the most tail of the web is transferred from a support wire in the press section of a pulp machine to the tail threading belt. Transfer may be effected using a suction roll with a suction sector and a blower sector, or by using a suction chamber having a perforated escort belt which cooperates with it to engage the tail section on the wire and fully support it during transfer to the threading belt. The threading belt may be folded over to contain the tail web inside it while it passes through the dryer.

27 Claims, 8 Drawing Sheets

U.S. PATENT DOCUMENTS 4,022,366 A 5/1977 Rooney
4,467,950 A 8/1984 Karlsson et al.
4,491,503 A * 1/1985 Adams et al. ..... 162/232
4,693,405 A 9/1987 Masse
4,698,919 A 10/1987 Wedel
4,904,344 A * 2/1990 Peiffer ..... 162/193
5,037,509 A 8/1991 Wedel
5,158,648 A * 10/1992 Weldon ..... 162/193
5,545,295 A * 8/1996 Fujita et al. ..... 162/358.1
5,735,060 A * 4/1998 Atzinger et al. ..... 34/117
5,762,759 A * 6/1998 Wedel ..... 162/193
5,817,215 A 10/1998 Kinnunen
6,022,452 A * 2/2000 Caspar ..... 162/286

* cited by examiner

SYSTEM AND METHOD FOR THREADING A MOIST WEB IN A PULP DRYER OR THE LIKE FROM ONE SECTION TO THE FOLLOWING SECTION

CROSS REFERENCE TO RELATED APPLICATION

This application is the U.S. national phase of PCT/FI99/00060 filed Jan. 29, 1999.

BACKGROUND AND SUMMARY OF THE INVENTION

The object of the present invention is a system and method for threading a moist web in a pulp machine or the like, such as a paper or board machine, from one section to the following section.

The object of the present invention is then typically a system for threading the tail of a pulp web from the press section to the dryer of the pulp machine. In pulp, board or paper machines there may be other corresponding points where it is necessary to transfer the moist web tail from one section of the machine to the following one. In such a case, the present invention obviously also concerns systems and methods for transferring the moist web at these points.

In this description of the invention, "the web tail"refers to the narrow, typically 120 mm wide, "web strip", which is cut off from the edge of the web by a cut parallel with the longitudinal direction of the track, the said strip being that part of the web which is passed first from one section of the machine, e.g. the press section, to the following section, e.g. the dryer, for example, after a web break or at the start-up of the machine. A so-called tail threading belt or the like is used for passing the web strip forward. Once the tail end of the web strip has run the desired distance through the second section of the machine, the narrow part of the web passing through the machine is allowed to broaden to normal web width.

In a typical pulp machine, the dry-matter content of the pulp web is increased in the press section to approximately 50%. After the press section, the pulp web is typically dried in an air dryer comprising several drying levels on top of each other, through which the pulp web is passed in a winding manner from the upper part of the dryer to its lower part. The length of the air dryer is typically about 20–50 m and the number of drying levels about 10–30. The length of the route-that the pulp web runs through the air dryer is thus typically approximately 500–1000 m.

At present, a pulp web is typically passed in a free transfer from the press section to the dryer. The above-mentioned narrow web strip cut off from the edge of the pulp web is used to facilitate the feeding of the moist pulp web from the press section to the dryer, the strip being typically passed through the entire dryer, before the web is allowed to broaden to its full width. In this case, the length of the web strip is also for the most part the same as that of the drying route, that is, for example approximately 500–1000 m.

A typical system for threading the moist tail of a pulp web, that is, the above-mentioned web strip, through the pulp dryer comprises a tail threading belt which forms a closed loop. The loop is typically arranged to pass through the dryer along the route of the pulp web to be dried from the point of entry of the web to the point of its exit, and once the tail of the web has been detached from the belt, to continue outside the actual dryer, from the point of exit of the web back to the point of its entry.

The tail threading belt is typically a belt folded over once, inside which fold the tail of the pulp web, that is, the web strip, is passed through the dryer. The moist tail of the pulp web is at present passed manually from the last support wire of the press section into contact with the tail threading belt. In this case, the fold of the moving tail threading belt is first opened to allow the tail of the pulp web to be placed inside the fold. When the tail of the pulp web has been placed inside the fold, the fold is closed in order to secure the tail of the pulp web inside the fold. After this the tail threading belt is passed to the dryer. The opening and closing of the belt fold usually takes place by means of opening wheels and closing pins known as such.

FIG. 1 shows a prior art system for passing a pulp web from the support wire 10 of the press section, by means of the tail threading belt 12, to the air dryer, of which only the first roll is shown in FIG. 1. The tail threading belt 12 is a belt folded over once, the fold of which is opened to bring the tail of the web inside the fold of the belt, and closed to hold the tail of the web secured to the belt while it conveys the tail of the web through the dryer. Prior to the stage shown in FIG. 1, the tail end of the moist web strip 18 has been manually brought into contact with the tail threading belt, after it has come out of the press section supported by the last support wire 10 and fallen down freely from the roll 14. FIG. 1 also shows by means of broken lines, the running of the pulp web 18' in the pulp machine during normal operation.

The functioning of a closing tail threading belt is previously known, for example, from the Finnish patent publication no. 55882. In the present description, "a tail threading belt or the like" refers to other tail threading arrangements known as such and comprised of endless rope, chain or cord-like means in addition to the tail threading belt disclosed in the above-mentioned Finnish patent publication, in which arrangements the web strip is pressed between two or more ropes, chains or cord-like means.

When, in the case shown in FIG. 1, the tail threading belt 16 has conveyed the tail end of the moist web strip 14 through the dryer, the forming of the strip is discontinued and the web is allowed to broaden to its normal full width. The use of the tail threading belt 16 can be discontinued after this. The pulp web will then typically run in a free transfer from the press section to the dryer, as shown by the broken lines.

Thus, at present the passing of the moist tail of the pulp web from the press to the dryer requires—in connection with each start-up e.g. after each interruption—a person who will take the moist tail of the pulp web manually from the press section towards the dryer and place this tail in the opened gap of the fold of the tail threading belt running at a considerable speed. This type of manual feed should be eliminated, if only because of the risk of accident.

The tail of the pulp web can usually be placed manually only in machines running at slow speeds of <150 m/min. At higher speeds, the risk of unsuccessful threading increases. Today, the speed of pulp machines is often as high as 160 m/min, and there is a need to run at even higher speeds exceeding 200 m/min, in future even at speeds of 300 m/min. At present, for the above-mentioned reasons relating to manual feed, the speed of the machine has to be slowed down to<150 m/min for the duration of the tail threading of the web, that is, the manual escorting stage, which then slows down the start-up of the machine.

Passing the web strip manually requires considerable skill. Transferring the pulp web strip freely, for example, from the press section to the dryer is not easy either, because the pulp web, which typically weighs about 500–1000 g/m2, may easily break when it is lifted freely to a relatively great height.

Nowadays, the tightening of the tail threading belt typically takes place in vertical tail threading belt tightening towers. In the tightening towers, the tail threading belt is guided to pass through a U-shaped loop, the lower part of the loop being fitted with a weight, which tightens the belt to the desired tightness. The tightening tower can usually not be fitted to the optimal point for the running of the tail threading belt at the wet end of the dryer, but instead it has to be fitted on the side of the machine, on the tending side of the machine, so that the tightening tower will not be in the way of the tender platform, which moves in front of the dryer, or the broke sail guiding the broke. At the dry end there is no need to make corresponding transfers of the tail threading belt, because the tail of the pulp web can be guided directly into the pulper chute.

In order to guide the tail threading belt into the tightening tower at the wet end of the dryer, the belt has to be moved sideways, that is, in the cross-web direction several times. The tail threading belt then has to be guided and pressed by means of different types of "fingers", "triangular plates" or the like in order to support the web, which is a strain on the belt. All these tail threading belt support measures tend to wear the belt when it is rotated. In addition, long free unsupported draws inside the tightening tower may cause the tail threading belt to turn inside the tower. As the speeds of pulp machines increase, these problems are aggravated and may thus limit the tail threading speed of the pulp web.

The aim of the present invention is, therefore, to achieve an improved system and method for passing the moist tail of a web into a pulp dryer or the like, in comparison to those previously known.

This means that the aim is to achieve the type of system and method for passing the moist tail of a web in a pulp dryer or the like which will enable a more rapid start-up.

A further aim is to achieve the kind of system and method in which the tail of the web can be attached to the tail threading belt automatically and safely.

The aim is then in particular to achieve a system in a pulp machine, by means of which the tail of the pulp web can be passed mechanically from the press section into/within the closing tail threading belt or the like at normal running speed, by means of which the tail of the pulp web can be conveyed over a sufficiently long distance between the press section and the tail threading belt, and by means of which it is ensured that the tail of the pulp web remains inside the closing tail threading belt also when the pulp web broadened to full track width is drawn into the dryer.

Yet another aim is to achieve a system with improved tightness adjustment of the tail threading belt.

In order to achieve the foregoing aims, the system relating to the invention for threading the moist tail of a web through a pulp dryer or the like includes characteristic features which may be summarized as follows hereinbelow.

One typical system relating to the invention for passing the moist tail of a web, that is, a web strip cut off from the moist web by a longitudinal cut, in a pulp machine, from the press section through the pulp dryer comprises, e.g.

a tail threading belt, which is formed of a belt folded over once and connected into a loop, means for guiding the tail threading belt along the route of the moist web to be dried through the pulp dryer, from the point of entry of the web to its point of exit, and on, from the point of exit of the web to the point of its entry, means for transferring the moist tail of a web from the press section to the tail threading belt and for securing it to the belt, the said means comprising a transfer means proper provided with means for bringing about a suction effect, for example, a suction roll equipped with a suction sector, or a means equipped with a suction box and a circulating escorting belt.

The transfer means may preferably be simultaneously fitted, for the duration of the tail threading, into contact with the moist tail of the web on the surface of the last support wire running in the press section, and into contact with the tail threading belt, in order to detach the moist tail of the web from the surface of the support wire by means of the suction effect, and to transfer it into contact with the tail threading belt. This means that the moist tail of the web will run for a certain distance along the circumference/surface of the transfer means at the transfer stage.

The system also comprises means for opening the fold of the tail threading belt folded over once, for fitting the moist tail of the web inside the fold, and means for re-closing the fold of the tail threading belt in order to secure the tail of the web to the tail threading belt. The fold of the tail threading belt is typically opened by means of so-called opening wheels, which for the most part open the fold fully, that is, to 180°. When the moist tail of the web has been brought into contact with the tail threading belt, while the belt moves continuously forward, the belt fold is closed, for example, by guiding with the closing pins. A web tail transfer means equipped with a suction sector is fitted preferably in contact with the tail threading belt, in the area between the tail threading belt opening means and the means for re-closing the fold.

In a preferred embodiment of the invention, the transfer means provided with a suction sector comprises a suction roll provided with a suction sector, the said roll being dimensioned to correspond to the width of the narrow tail to be cut off the web, which is approximately 100–200 mm. The overall length of the suction roll, in the direction of the axis is preferably slightly greater than the width of the tail of the web, so that the axial length of the suction sector of the suction roll corresponds to the width of the tail of the web. The diameter of the suction roll is preferably about 300–350 mm.

The suction roll is fitted above the web running, for example, on the bottom felt/support wire of the last press, in cross-web direction, on that section of the web which has been cut or will be cut for tail threading. The suction roll is preferably fitted above this narrow tail of the web so that the suction sector of the suction roll comes into contact with the web at the nip between the felt and the suction roll, or immediately after it. In this case, the suction sector is preferably arranged to extend at least over a short distance on the exit side of the nip between the felt and the suction roll, in which case the suction sector will lift the tail of the web off the felt after the nip, and guide the tail forward along a track following the curvature of the suction roll. The tail of the pulp web covers a part of the circumference of the suction roll during the transfer.

In a preferred embodiment of the invention, the tail threading belt is brought close to the last press felt/support wire so that the suction roll can be fitted between the felt and the tail threading belt, in contact with both. The first nip is then formed between the felt and the suction roll, and a second nip between the suction roll and the tail threading belt. The suction roll, felt and tail threading belt are fitted in such a way with respect to each other that the suction roll in the first nip rotates in the direction of the felt, and in the second nip in the direction of the tail threading belt. In this case the suction sector of the suction roll is arranged to extend from the first nip almost up to the second nip, which means that the suction roll conveys the tail of the web detached from the felt and transferred onto the suction roll from the first nip to the second one. However, the suction sector ends preferably slightly before the second nip, so that the tail of the web on the second nip can be transferred from the suction roll to the tail threading belt.

At the second nip, that is, the nip formed by the suction roll and the tail threading belt, air can be arranged to blow on the suction roll, which facilitates the transfer of the web tail towards the tail threading belt. Air blowing to detach the tail of the web can also be achieved, if desired, by means of a separate blowpipe fitted immediately after this second nip.

According to another preferred embodiment of the invention, the tail threading belt is also arranged to run through the first nip between the suction roll and the felt, between the moist web on the suction roll and the felt. In this case the suction sector of the suction roll is arranged at the nip and to extend a short distance on from the nip in the direction of travel of the web. The suction sector sucks the tail of the web, on the nip and over a short distance after it, by means of suction taking place through the substantially air-permeable tail threading belt, bringing it into contact with the tail threading belt, at the same time detaching the tail of the web from the felt. The length of the suction sector on the circumference of the suction roll depends, among other things, on the overall geometry of the tail threading arrangement. However, the suction sector preferably continues on from the nip far enough for the tail of the web passing through to detach in a controlled manner from the felt, to run with the tail threading belt over a distance around the circumference of the suction roll, and to become attached to the tail threading belt.

If necessary, a suction box or other similar means may be arranged in conjunction with the tail threading belt, after the suction roll, by means of which suction box or the like it is ensured that the moist web tail remains attached to the tail threading belt until the belt is again closed, that is, folded over once.

The suction roll relating to the invention functions so that it takes the web tail, that is, the pulp tail end from the bottom felt of the press and transfers it to the opened tail threading belt. The pass over to the tail threading belt functions reliably, safely and rapidly.

The suction roll described above and relating to the preferred embodiment of the invention could be replaced, for example, by an escorting belt of a suitable size and passing over two rollers, such as a felt or wire loop, in which case the tail of the web detached from the support wire of the press is guided by means of the said escorting belt towards the tail threading belt. In this way the tail of the web can be detached from the felt by means of suction through the escorting belt. This means that the suction sector can be arranged in the rollers controlling the escorting belt, or in separate suction boxes or chambers fitted inside the escorting belt.

In web tail transfer taking place by means of a felt or wire loop, the moist tail of the web can be transferred over longer distances, in which case the tail threading belt does not need to be moved towards the support wire of the press section at the start of tail threading.

It is characteristic of the solution relating to the invention that it comprises equipment which is used to grip the moist web strip and to detach it, for example, from the support wire of the press section, and to take it on to a tail threading belt or the like, typically inside a belt which can be folded over once. The equipment can be arranged to function at the normal running speed of the pulp machine. When an escorting belt is used, the equipment can be arranged to convey the moist tail of the web over a desired distance inside the tail threading belt. By means of the escorting belt it can be ensured that the moist tail of the web remains on the tail threading belt until the belt has closed, By means of the solution relating to the invention, the moist tail of the web, the web strip, to be transferred can be escorted as desired, for example, until the tail end of the web has reached the upper part of the dryer by means of the tail threading belt, passed through the first drying level of the dryer, or even until the tail end has passed through the entire dryer. By means of the apparatus relating to the invention, the moist tail of the web passing by the apparatus can thus be guided not only when the tail end of the web itself is fed into the tail threading belt, but over a considerably longer period, that is, for as long as there is a need to do so. The solution relating to the invention allows the conveyance of, for example, a 50–100 meter long, or even longer, tail/web strip in a controlled manner from the press section to the dryer.

When the tail of the web has been conveyed in a controlled manner into the dryer, the operation of the apparatus is discontinued, and the tail of the web is merely pulled by means of the tail threading belt in the usual manner until the pulp web has finally broadened to its normal track width.

In the solution relating to the invention the tightening tower can be replaced by a mainly horizontal draw, for example, a "tightening carriage" in a horizontal position, which is installed either above or below the dryer. There is usually space above and below a pulp dryer for arranging these narrow tail threading belt runs. Therefore, there is no need to move the tail threading belt laterally, away from its natural run, which means that there is no need for additional belt guides or pressure which cause wear to the belts. Often tail threading speeds can also be increased.

The required tightening force is obtained by means of wires, for example, on a vertical post, which can be located, for example, close to the wall of the machine room. Alternatively, the required tightening force can be created by means of a pneumatic cylinder or the like. In this case the tightness of the tail threading belt can be adjusted continuously and tightness be reduced when the belt is not running, which would be advantageous for the belt.

BRIEF DESCRIPTION OF THE DRAWINGS

The invention is described in the following with reference to the appended drawings in which.

DETAILED DESCRIPTION OF THE DRAWINGS

Figure 1:
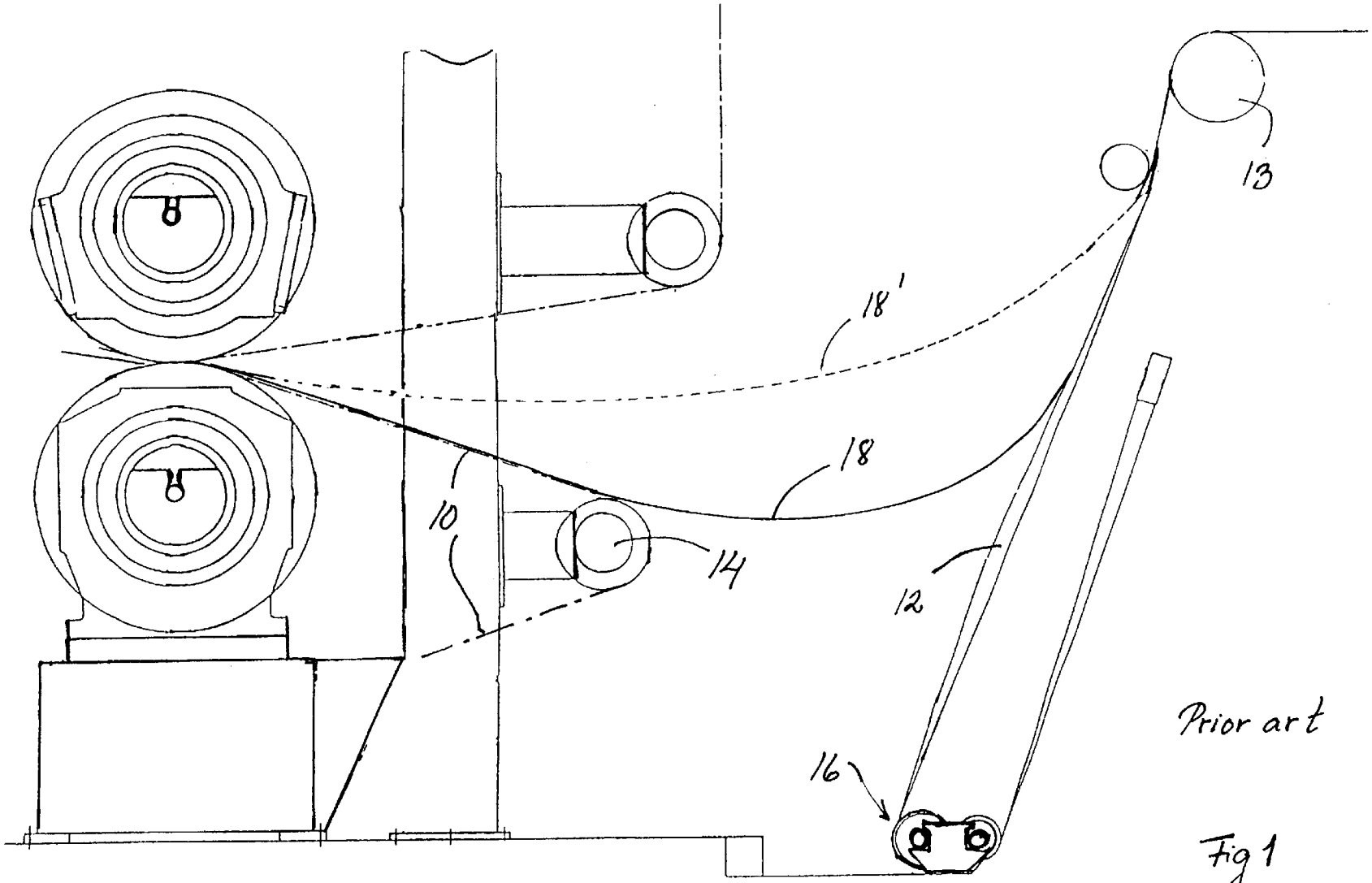
Prior art Fig 1
FIG. 1 shows a prior art arrangement for passing the web from the press section of the pulp machine to the dryer.

FIG. 1 shows diagrammatically the known arrangement described at the beginning of the specification for passing a pulp web from the press section of a pulp machine to the dryer.

Figure 2:
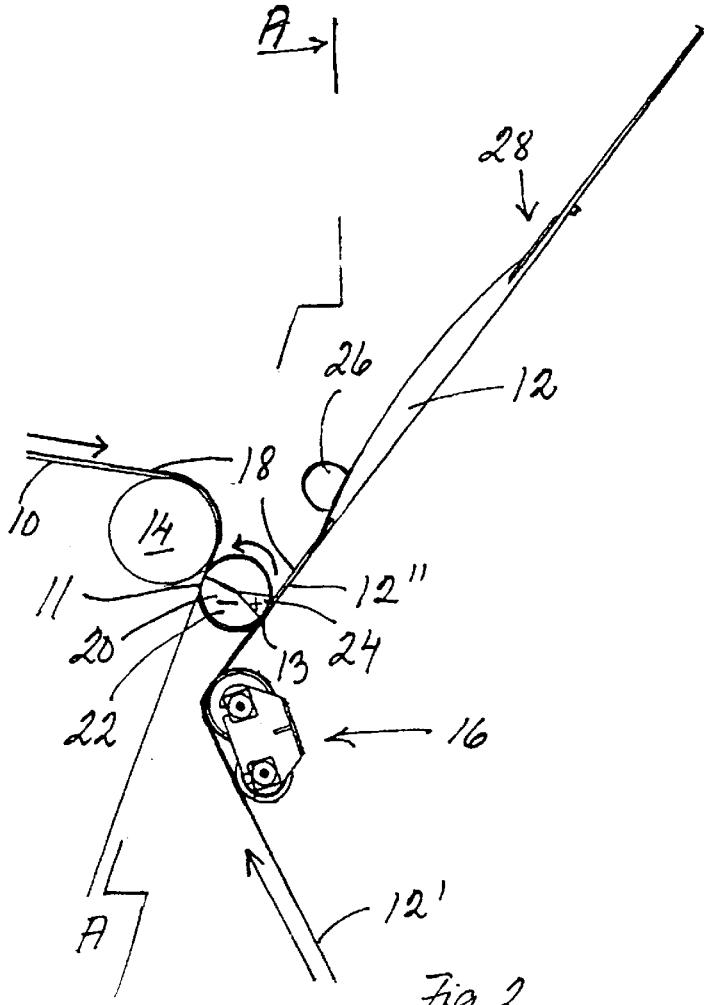
FIG. 2 shows diagrammatically, and by way of an example, the system relating to the invention for the automatic transfer of the moist tail of a pulp web from the press felt to the tail threading belt.
Figure 3:
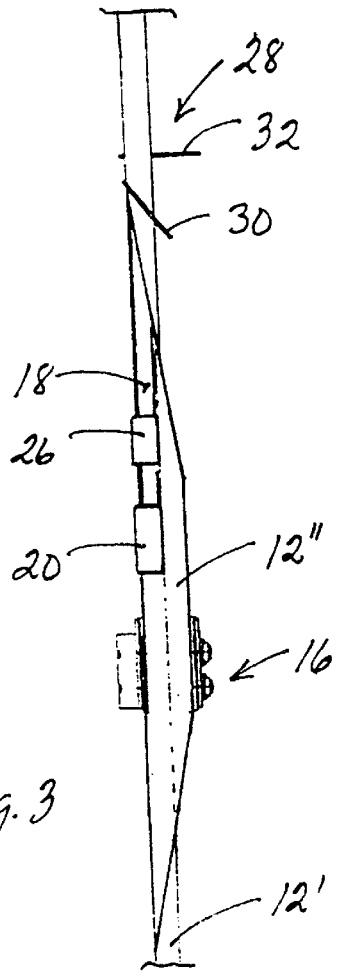
FIG. 3 shows a part of the tail threading belt shown in FIG. 2, as seen along line AA

FIGS. 2 and 3 show tail threading according to an automatic pulp web tail threading system from the last bottom felt of the press to the tail threading belt 12. The felt 10 runs in the direction indicated by the arrow around the roll 14. The tail threading belt 12 runs in the direction indicated by the other arrow, past the opening wheel 16, where the belt 12' folded over once is opened to its full width 12" while the tail 18 of the pulp web is being transferred from the felt 10 into contact with the tail threading belt 12.

The transfer of the tail 18 of the web takes place by means of a suction roll 20, which is fitted between the felt 10 and the tail threading belt 12 in order to form nips 11 and 13 together with them, and which roll runs in the direction indicated by the arrow. The suction sector 22 is marked on the suction roll 20 with the marking "−", which suction sector extends mainly from the felt 10 to the tail threading belt 12. Following the suction sector, on the suction roll there is additionally arranged a short blowing sector 24 marked with "+", in which the tail 18 of the web which has transferred from the felt to the suction roll is blown off the suction roll, towards the tail threading belt 12. The length of the suction roll parallel to the axis is preferably half the width of the tail threading belt, as can be seen in FIG. 3. The width of the tail of the pulp web is generally about half the width of the opened tail threading belt.

At a short distance from the suction roll, a wheel 26 can be fitted against the tail threading belt if necessary, which wheel will press the tail of the pulp web towards the tail threading belt 12. The tail threading belt closing means 28, which comprise a first closing pin 30 on the first side of the belt, and a second closing pin 32 on the other side of the belt, may, on the other hand be fitted at such an optimum distance from the suction roll 20 that they will cause the tail threading belt to close immediately after the suction roll, in which case the tail of the pulp web will be attached to the belt even without the roll.

Figure 4:
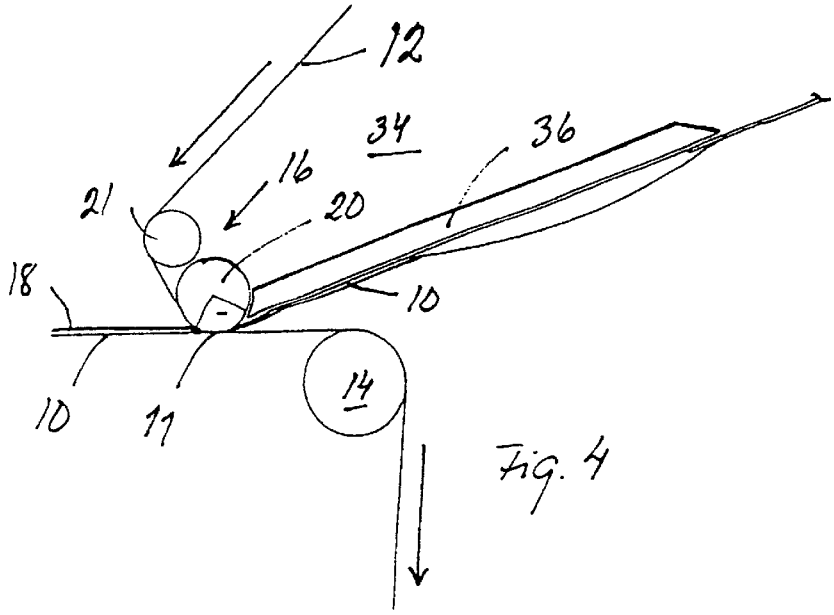
FIG. 4 shows diagrammatically, and by way of an example, a second system relating to the invention for the automatic transfer of the tail of a pulp web from the press felt to the tail threading belt.

FIG. 4—which uses the same reference numerals as FIGS. 2 and 3 where applicable—shows another solution relating to the invention for transferring the tail 18 of a pulp web from the press felt 10 to the tail threading belt 12 which is to be opened. In this solution, the suction roll 20 is fitted inside a loop 34 formed by the tail threading belt, so that the tail threading belt runs through a nip 11 formed by the felt 10 and the suction roll 20. In this solution, the suction roll 20 and the wheel 21 preceding it also form the opening wheel 16 of the tail threading belt. The tail of the pulp web is arranged so as to become attached to the belt 12 to be folded, at the other side from the point where the fold will be made, so that the belt fold can be closed without folding the tail of the pulp web.

In another solution relating to the present invention, a suction box 36 is in addition to the suction roll 20 fitted inside the tail threading loop 34, the said suction box keeping the tail 18 of the pulp web attached to the tail threading belt 12 by means of suction taking place through the tail threading belt until the belt has closed and continues its travel towards the pulp dryer folded over once. Instead of a suction box 36, in the solution relating to the invention, other means can be used to create a vacuum, such as a blow box which creates a vacuum.

In this solution relating to the invention, the tail threading belt 12 is partly gas-permeable, so that the suction effect of the suction roll 20 and the suction box 36 can be exerted through the belt 12 on the tail 18 of the pulp web.

Figure 5:
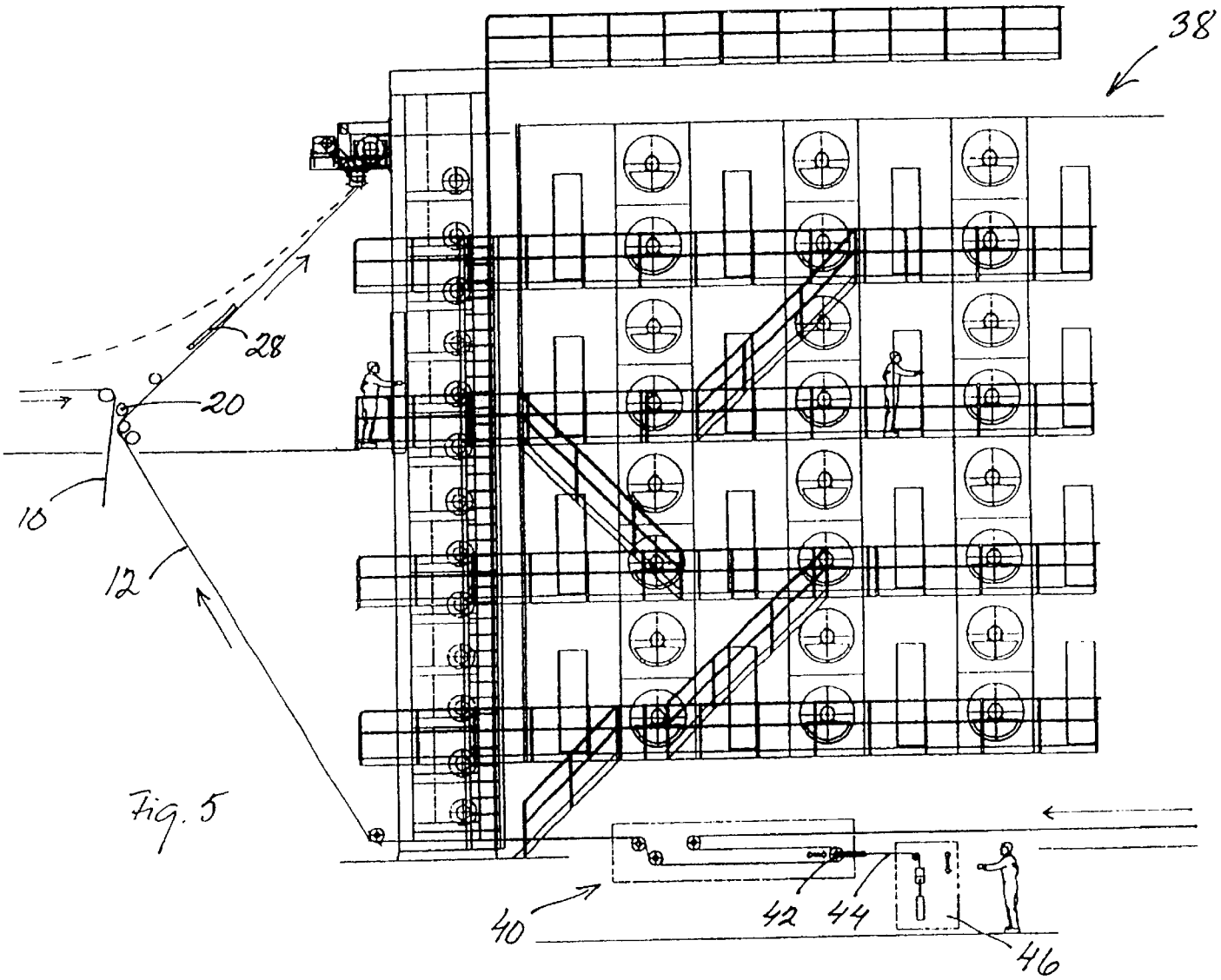
FIG. 5 shows diagrammatically a part of a pulp dryer in which is incorporated the automatic transfer of the tail of a pulp web from the press felt to the tail threading belt, as shown in FIG. 2.

FIG. 5 shows a part of a multilayer pulp dryer 38, at the wet end of which is fitted pulp web tail transfer from the press felt 10 to the tail threading belt 12, in accordance with the invention. tn the solution shown in FIG. 5, the tail threading belt 12 has been brought close to the felt 10, which can best be seen in FIG. 2. Of the tail threading belt closing means 28 FIG. 5 shows the long support of the closing means, to which the closing pins are attached.

When, in tail threading, the tail has been passed by means of the once folded tail threading belt to the dryer, for example over a distance of about 40 meters, and when no further escorting of the tail from the felt 10 to the belt 12 is needed, the suction roll 20 is pulled out of the machine, that is, away from contact with the felt. The tail threading belt carries the tail through the dryer, all the way to the exit.

FIG. 5 shows with broken lines the passage of a pulp web extending across the full width of the track, during normal operation of the machine.

FIG. 5 further shows a tail threading belt tightener 40 fitted below the dryer 38, the said tightener comprising a tightening carriage 42 and a pulling means 46 connected to it by means of a wire 44, which pulling means may in the case of FIG. 5 be a weight or, for example, a pneumatic cylinder. The tail threading belt is tightened in the case shown in FIG. 5 when the belt has passed through the dryer and before the tail of the pulp web is attached to it.

Figure 6:
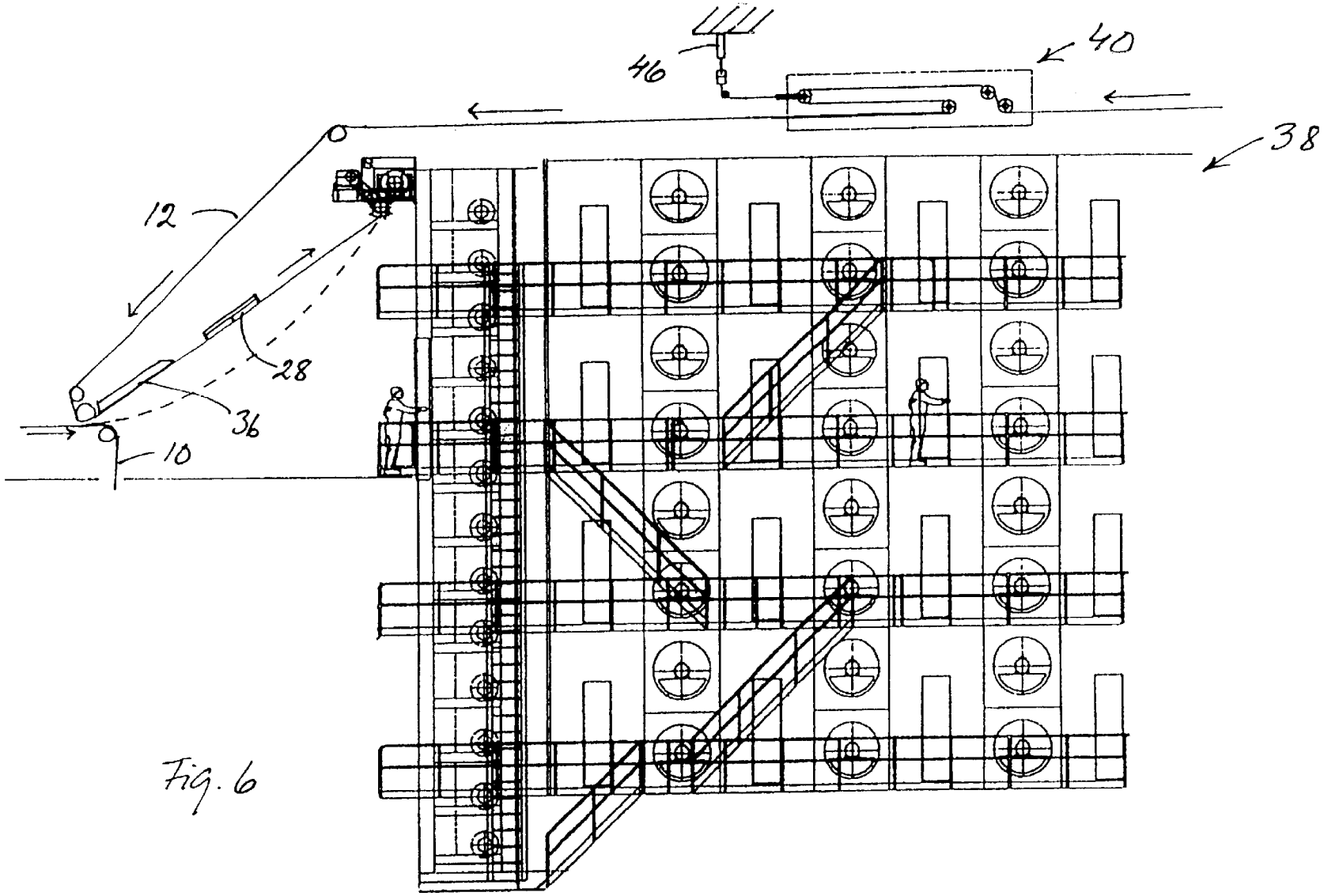
FIG. 6 shows diagrammatically a part of a pulp dryer in which is incorporated the automatic transfer of the tail of a pulp web from the press felt to the tail threading belt, as shown in FIG. 4.

FIG. 6 shows, in the same way as FIG. 5, a part of a multilayer pulp dryer 38. Tail threading in this dryer takes place by utilising the system relating to FIG. 4. In the case of FIG. 6 the tail threading belt 12 runs from above towards the press felt 10, that is, in a manner opposite to the case shown in FIG. 5. The tail threading belt takes the tail of the pulp web, attached to its underside by means of the suction box 36, to the belt closing means 28. In this case the tail threading belt tightener 40 is fitted above the dryer. The pulling means 46 is attached to the frame structure. The broken lines show the passage of the pulp web during normal operation.

FIGS. 7–10 show various views of an apparatus relating to the invention, which differs from that shown in FIGS. 2–6. The same reference numerals have, however, been used in FIGS. 7–10 as in FIGS. 1–6, where applicable.

Figure 7:
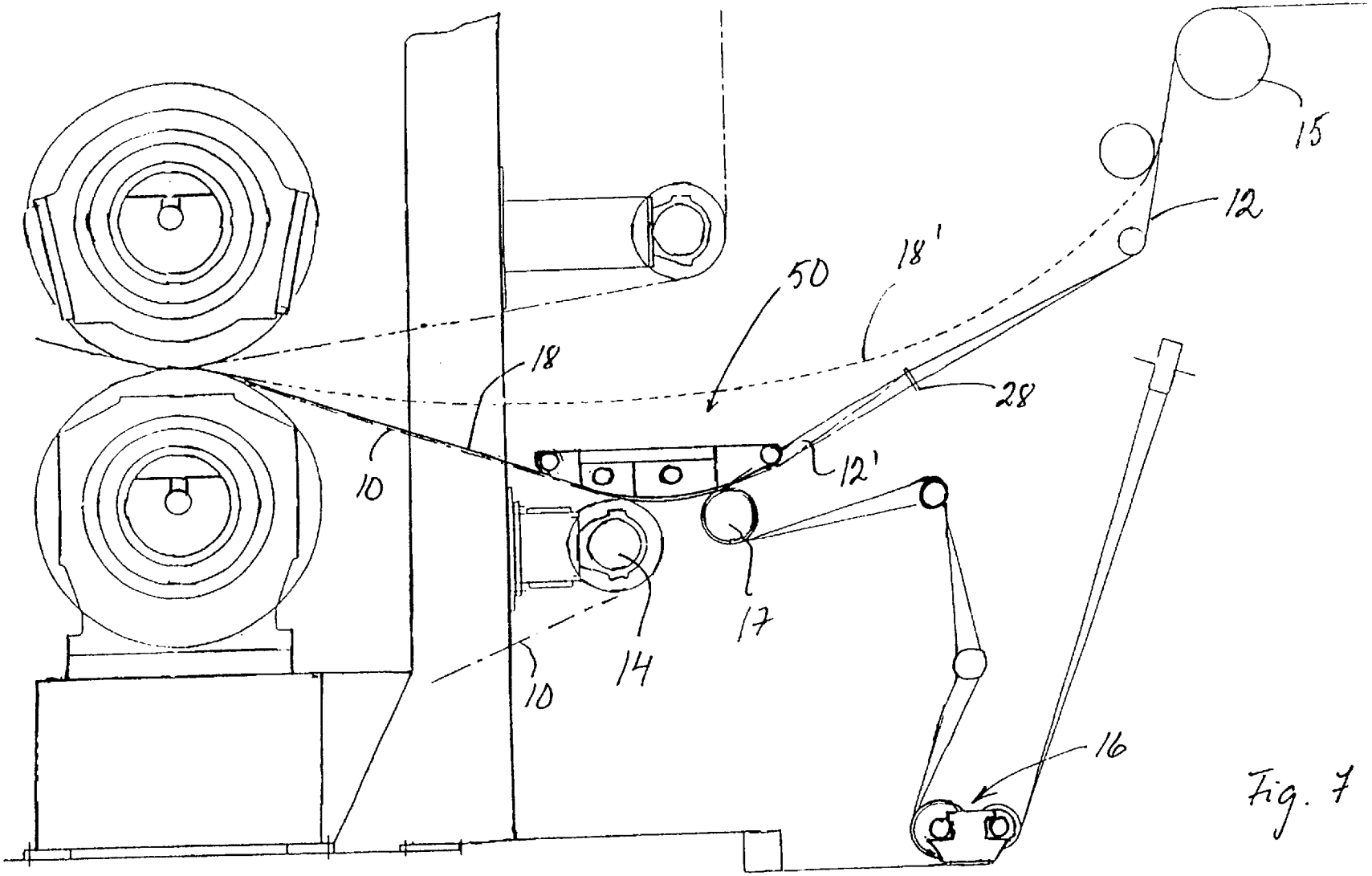
FIG. 7 shows a third solution relating to the invention for transferring the tail of a pulp web from the press to the dryer, as a diagrammatical side view similar to FIG. 1.
Figure 8:
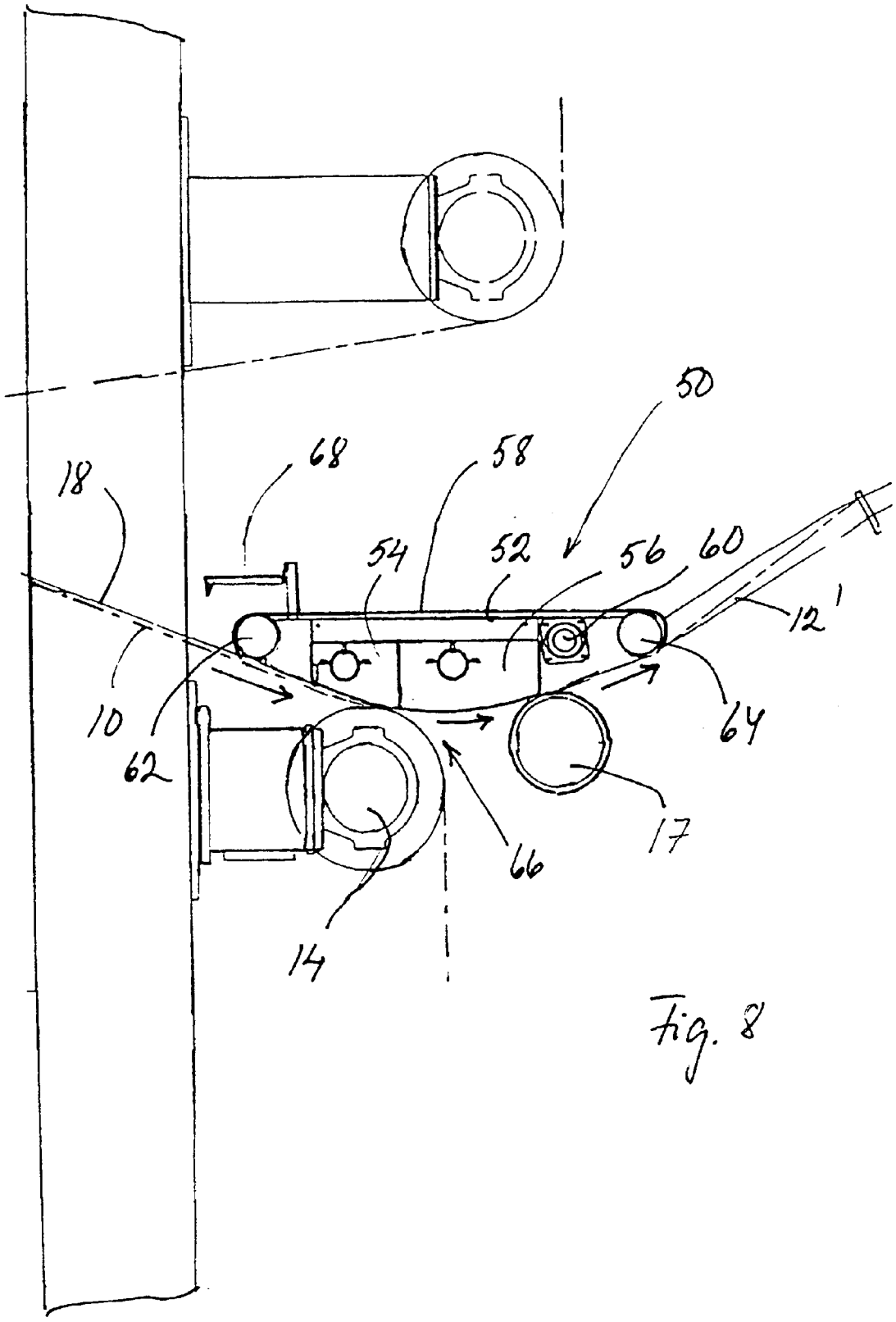
FIG. 8 shows the apparatus shown in FIG. 7 as seen from the side, on a slightly magnified scale compared with FIG. 7, and in addition provided with means for cutting the moist web tail.

FIGS. 7 and 8 show a pulp web tail transfer system relating to the invention from the last support wire, that is, the bottom wire 10 to the tail threading belt 12. The tail threading belt 12 has been brought by means of a roll 17 close to the roll 14 which controls the bottom wire 10 of the press. The transfer means or transfer apparatus 50 relating to the invention is lowered down onto the rolls 14, 17 for the duration of tail threading, in order to cover the gap between the rolls.

By means of the apparatus 50 relating to the invention, the moist tail 18 of the web running along the bottom wire 10 is detached from the bottom wire and passed in a controlled manner to the opened fold 12' of the tail threading belt 12. The fold in the belt has been opened by means of the opening wheels 16. When the tail of the web has been fitted into the opened fold of the belt 12, the fold is closed by the closing means 28, for example, guiding pins, after which the tail 18 of the pulp web is conveyed inside the tail threading belt 12 on to the dryer, of which only the first roll 15 has been shown. FIG. 7 also shows with broken lines the passage of a web 18' extending across the full width of the track, during normal operation.

The transfer apparatus 50 relating to the invention shown in FIG. 8 comprises a frame part 52, inside which are formed two suction chambers 54 and 56, placed one after the other in the direction of the track. Around the frame part an escorting belt 58 is arranged to run, which escorting belt is pressed on the one hand against the support wire 10 conveying the tail of the pulp web, and on the other hand against the opened tail threading belt 12', when the apparatus 50 is in 10 the operating position shown in FIG. 8. The escorting belt is rotated by means of the driving means 60 so that the direction of travel of the escorting belt in the case of FIG. 8, below the apparatus 50, is the same as the directions of travel of the support wire 10 of the press (on the bottom wire) and of the tail threading belt 12, which are indicated by arrows. In the transfer apparatus, inside the escorting belt loop, at the ends of the frame part are fitted rollers 62 and 64 to guide the passage of the escorting belt. The escorting belt 58 is arranged to rotate by means of rollers 62, 64, to at least one of which is connected a motor or other driving means 60, for rotating the escorting belt at a controllable speed. The speed can be set, for example, by means of a pulse sensor and a counter. A control box is preferably arranged (not shown) for the transfer apparatus, the said box comprising, e.g. solenoid valves and a control unit, by means of which the apparatus can be connected to the controls of the pulp machine.

The tail 18 of the pulp web transferred from the press to the dryer is passed on the support wire 10 of the press to the nip 66 between the transfer apparatus 50 and the support wire 10 turning roll 14. The escorting belt 58 of the transfer apparatus is preferably perforated or at least slightly air permeable in some other manner. The suction chambers 54, 56 are fitted in the transfer apparatus in such a way that, while the transfer apparatus is in a position for the tail transfer, they exert suction through the escorting belt, first towards the tail 18 of the pulp web running on the support wire 10 and after this towards the tail of the pulp web running free between the rolls 14, 17. By means of the vacuum in the suction chambers, the tail of the pulp web is caused to become attached to the escorting belt 58, to become detached from the support wire 10 and to follow the escorting belt, also after the nip 66 between the support wire turning roll 14 and the transfer apparatus 50.

The vacuums in the suction chambers 54, 56 can be regulated so that either the same or a different pressure level prevails in the chambers. At least one of the suction chambers 54 is preferably located on the frame part 52 of the apparatus 50 so that its suction effect is already exerted on the tail of the pulp web being transferred before the nip 66. The escorting belt 58 will then run for a short distance on the support wire 10 and parallel with it. In the case shown in FIG. 8, after the nip 66 the tail of the pulp web to be transferred is conveyed by means of the other suction box 56, attached to the escorting belt, into contact with the opened tail threading belt 12'. The tail of the pulp web covers part of the circumference of the escorting belt.

FIG. 8 further shows a diagrammatic view of a water cutter 68 fitted above the tail of the pulp web supported by the support wire 10 and at a short distance before the nip 66, by means of which cutter an oblique tail end can be cut at the tail 18 of the pulp web at the start of tail threading. The cutter, which may be fixed to the transfer apparatus 50 or other appropriate support means, can be moved across the tail of the pulp web, in which case it will cut an oblique tail end at the tail of the pulp web. An oblique tail end makes it easier to bring the tail of the pulp web inside the tail threading belt.

Figure 9:
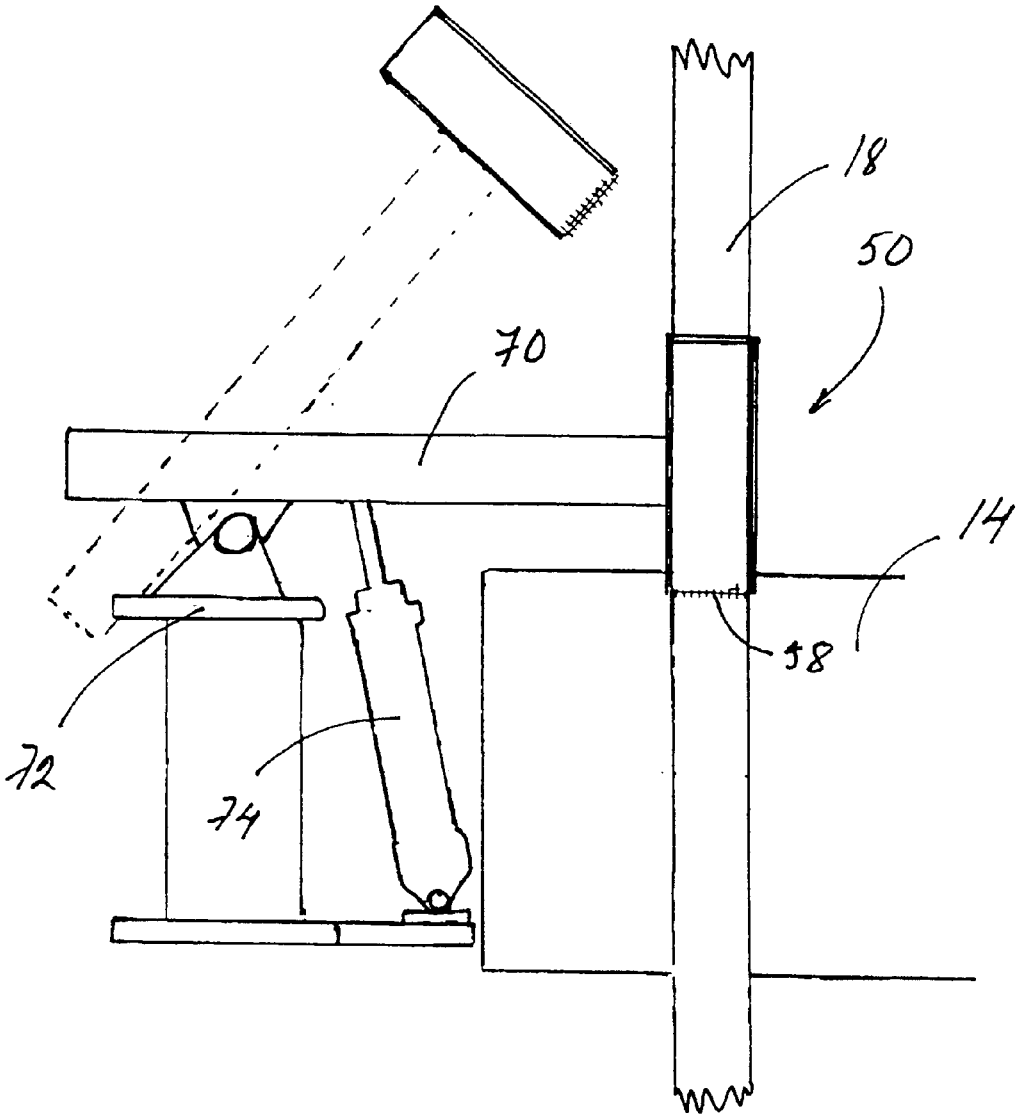
FIG. 9 shows the apparatus shown in FIG. 7 as seen in the direction of travel of the track, in two different positions.
Figure 10:
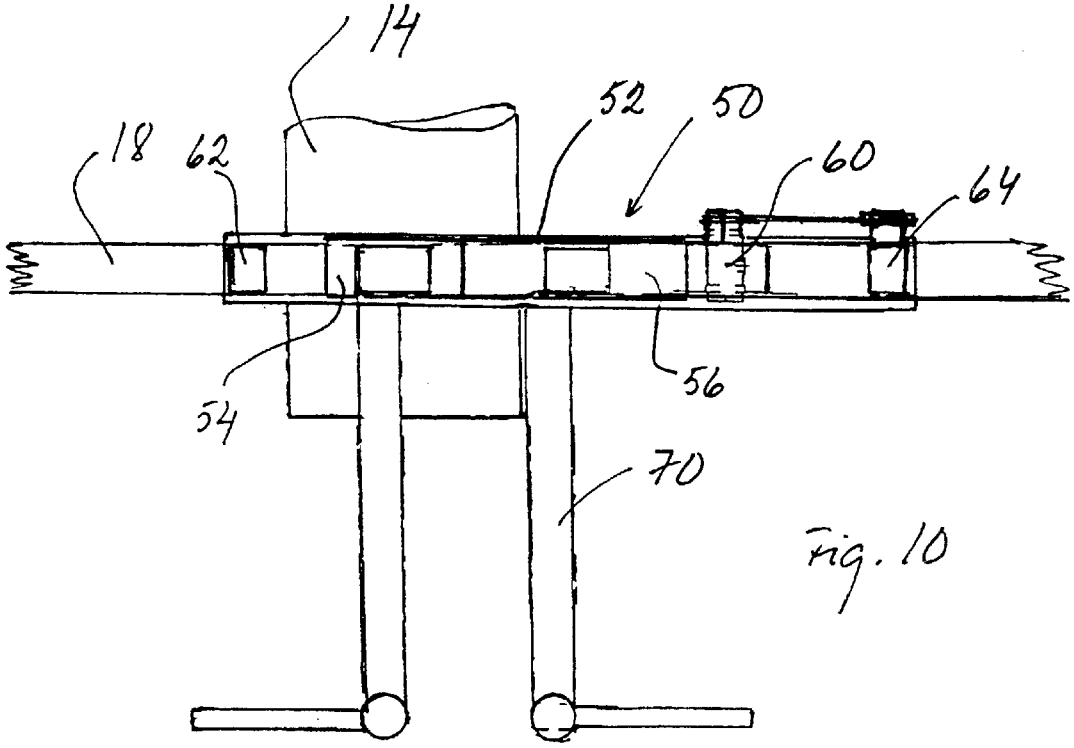
FIG. 10 shows the apparatus shown in FIG. 7 as seen from above.

The transfer apparatus 50 relating to the invention shown in FIGS. 7 and 8 is in FIG. 9 shown as seen in the direction of the track of the pulp machine, and in FIG. 10 as seen from above. FIGS. 9 and 10 show that the transfer apparatus 50 comprises a frame part proper 52 and two support parts 70 protruding outwards from this part, the said support parts being pivotably fixed to the support means 72 on the side of the machine. As FIG. 9 shows, during tail threading, the transfer apparatus is for the most part lowered down into a horizontal position towards the roll 14 and the tail 18 of the pulp web being transferred. During normal operation of the pulp machine, the transfer apparatus can be lifted upwards into an oblique position, as shown with broken lines in FIG. 9. The apparatus can be moved between the tail threading position and an inoperative position by means of hydraulic cylinders 74, which are fixed to the outwards protruding support parts 70 of the apparatus. The outwards protruding support parts are preferably fitted with vacuum tubes (not shown), which can be used to create a vacuum in the suctions chambers. The vacuum tubes are provided with valves.

When the apparatus relating to the invention is being used, the pulp machine itself is first regulated to run at normal operation speed, as is the dryer and the tail threading belt. The transfer apparatus 50 is then started up while it is in the upper position shown in FIG. 9, and the escorting belt 58 is accelerated basically to the speed of the track. After this, the transfer apparatus 50 is lowered down towards the tail 18 of the pulp web running on the support wire 10 of the press, and the valves of the vacuum tubes leading to the suction chambers 54, 56 are opened to create a vacuum in the suction chambers. Extremely rapid appliance of a vacuum brought about in this or other appropriate manner to the transfer apparatus causes a rapid jerk-like movement at the tail of the pulp web passing along the support wire and already falling down from the roll 14 at its front end, the said jerk-like movement cutting the tail of the pulp web (the pulp web strip) at the start of the transfer apparatus. After cutting, the new tail of the pulp web, which is light at first, easily becomes attached to the escorting belt 58 due to the effect of the suction created by the suction chambers, and runs forward guided by the escorting belt, towards the tail threading belt 12.

In some cases it may be difficult to achieve the rapid cutting by tearing described above. Furthermore, the tail end of a pulp web made by tearing may be ragged on the edge.

If cutting by tearing cannot be done or a precisely determined oblique tail end is desired, the tail of the web can be cut, e.g. by means of a water jet cutter, as disclosed above.

Figure 11:
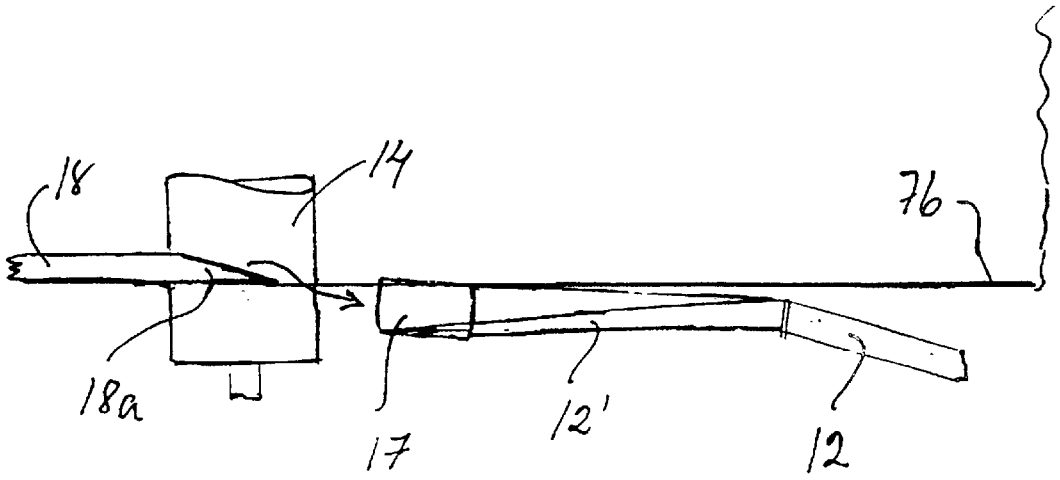
FIG. 11 shows diagrammatically, in the apparatus shown in FIG. 7, the guiding of the moist web tail so as to be parallel with the tail threading belt.

FIG. 11 shows diagrammatically the threading of the tail 18 of the pulp web into the tail threading belt 12, as seen from above. FIG. 11 also shows the line 76 of the edge of the pulp web during normal operation. The tail threading belt 12 is fitted to run somewhat outside this alignment. The roll 17 brings the tail threading belt 12 close to the support wire of the press and the roll 14 guiding the tail 18 of the pulp web. The transfer apparatus relating to the invention (which is shown in FIGS. 17–10) guides the tail 18 of the pulp web running past the transfer apparatus towards the tail threading belt for the duration of the tail threading, that is, to run somewhat outside the normal pulp web alignment 76. In order to be able to place the tail 18 of the pulp web properly inside the opened fold of the tail threading belt, the tail end 18*a* of the pulp web is cut obliquely as shown in FIG. 11, so that the narrowest part of the tail end is able to penetrate deep into the fold of the tail threading belt.

In order to transfer the tail 18 in a controlled and reliable manner from the press to the dryer, the tail of the pulp web coming from the press may be passed by means of the escorting belt to the tail threading belt for a considerable time. The length of the escorted tail of the pulp web may typically be about 30–100 m, which corresponds to the joint length of the height of a typical dryer and the first drying level.

When a desired length of the new pulp web tail following cutting is conveyed by means of the escorting belt 58 to the tail threading belt, the above-mentioned vacuum valves of the vacuum tubes of the suction chambers 54, 56 and the transfer apparatus are lifted up. After this, the tail of the pulp web is conveyed, in the usual manner, that is, without the escorting belt, the desired distance through the drying route of the dryer. When a suitable pulp web tail has been passed in a suitable manner through the dryer, the formation the pulp web tail, that is, longitudinal cutting, is discontinued, and the web running from the press to the dryer is allowed to broaden to its full track width. Once the whole full-width pulp web has been pulled onto the drawing rolls in the dryer, the operation of the tail threading belt can be discontinued and the normal operation of the pulp machine can begin.

The solution relating to the invention enables automatic tail threading of the web, which is safe, reliable and allows higher speeds even during tail threading.

The solution relating to the invention in which the tightening of the tail threading belt is arranged to take place by horizontal draws and in which the tightener is fitted above or below the dryer, provides more open space on the tending side of the dryer for other functions. At the same time this solution avoids the belt-wearing rotations and guiding that are involved in the tightening tower solution.

The aim is not to limit the invention to the foregoing embodiments presented by way of examples, but on the contrary to be able to utilise it within the scope of protection determined by the claims presented below.

What is claimed is:

1. A system for threading the moist trail of a pulp web from a first section of a pulp machine to a second section following the first section, along a route of the moist pulp web in the pulp machine, said system comprising:

a tail threading belt, which forms a closed loop, and is positioned to run along at least a part of the route of the moist pulp web through at least a part of the second section of the pulp machine;

means for transferring the moist tail of the pulp web from the first section of the pulp machine to the tail threading belt, comprising means for attaching the moist tail of the pulp web to the tail threading belt;

said means for transferring the moist tail of the pulp web from the first section of the pulp machine to the tail threading belt comprising a transfer device which generates a suction effect to facilitate attachment of the pulp web tail thereto;

a support wire running in at least a part of said first section of the pulp machine; and said transfer device being in contact with the moist tail of the pulp web on the surface of said support wire running in said first section, substantially for the duration of tail threading, and also positioned in conjunction with said tail threading belt in order to detach, by the suction effect, the moist tail of the pulp web from the surface of the support wire and to transfer the moist tail into contact with the tail threading belt.

2. A system as recited in claim 1 wherein said transfer device has a surface that is at least partly curved, and positioned so that, during tail threading, said curved surface is at least partially covered by the moist tail of the pulp web.

3. A system as recited in claim 2 wherein the suction effect is generated in the curved part of the transfer device.

4. A system as recited in claim 1 wherein said first section of the pulp machine comprises a press, and wherein said second section comprises a dryer.

5. A system as recited in claim 4 wherein said tail threading belt is positioned to run through at least a first drying level of said dryer.

6. A system as recited in claim 4 further comprising a tightening means connected to a loop of said tail threading belt, on a run above or below said pulp dryer, to effect tightening primarily by a horizontal draw.

7. A system as recited in claim 1 wherein said tail threading belt may be folded over once to receive the moist tail of the pulp web when conveyed through said second section; and wherein said system further comprises means for unfolding the tail threading belt to allow the moist tail of the pulp web to be fit therein, and means for folding over the tail threading belt so that the moist tail of the pulp web is inside the folded over belt when the pulp web is conveyed through said second section.

8. A system as recited in claim 7 wherein said means for unfolding the fold of the tail threading belt comprises opening wheels, and wherein said means for folding over the tail threading belt comprises closing pins.

9. A system as recited in claim 7 wherein the suction effect of said transfer device is provided between said unfolding means and said folding means.

10. A system as recited in claim 7 further comprising cutting means for cutting the moist tail of the pulp web before it passes inside said tail threading belt.

11. A system as recited in claim 10 wherein said cutting means comprises a high pressure water jet cutter movable across the moist pulp web tail to form an oblique tail end at the tail of the pulp web.

12. A system as recited in claim 7 wherein said tail threading belt, a power source for moving the tail threading belt, and said means for unfolding and folding over said tail threading belt, are positioned outside the line of a normal track; and wherein said transfer device is positioned obliquely outwardly from said line of a normal track to guide and convey the moist tail of the pulp web toward said tail threading belt.

13. A system as recited in claim 1 wherein said second section comprises a pulp dryer; and wherein said tail threading belt is positioned to pass primarily along the route of the pulp web to be dried through said pulp dryer, from the point of entry of the pulp web to its point of exit, and to continue, outside said pulp dryer, from the point of exit of the pulp web back to its point of entry; and wherein said transfer device comprises a suction roll having a suction sector, said suction roll positioned so that the tail of the pulp web passes through a first nip formed by said support wire and said suction roll, and wherein said suction sector detaches the tail of the pulp web from said support wire.

14. A system as recited in claim 13 wherein said suction roll is positioned between the tail of the pulp web on the surface of said support wire, and said tail threading belt, so that said tail threading belt and said suction roll form a second nip after said suction sector of said suction roll.

15. A system as recited in claim 14 further comprising a blowing sector on said suction roll at said second nip for transferring the tail of the pulp web from said suction roll into contact with said tail threading belt.

16. A system as recited in claim 13 further comprising a suction box operatively positioned with respect to said tail threading belt after said suction roll for transferring the tail of the pulp web into contact with said tail threading belt.

17. A system as recited in claim 1 wherein said transfer device comprises: a frame part to which is connected at least one suction chamber; and an escort belt rotating around said frame part, and positioned so that by movement of the frame part said escort belt is moved into contact with the moist tail of the pulp web on the surface of said support wire and as a result of the suction generated by said suction chamber causes the moist tail of the pulp web to detach from said support wire.

18. A system as recited in claim 17 wherein said escort belt is perforated.

19. A method of threading the moist tail of a pulp web from a first section of a pulp machine to a second section following the first section, the pulp machine having a support wire running in at least part of the first section, and a tail threading belt running in at least part of the second section, the method comprising:

(a) cutting a narrow strip from the moist pulp web having a width corresponding to the operative width of the first section, so as to form a moist tail of the pulp web to be passed to the second section;

(b) securing the moist tail of the pulp web to the support wire running in the first section;

(c) using a suction effect, exerting. a force on the moist pulp web tail supported by the support wire to detach the moist pulp web tail from the support wire;

(d) transferring the moist tail of the pulp web detached from the support wire to the tail threading belt; and (e) passing the moist tail of the pulp web in contact with the tail threading belt through at least part of the second section of the pulp machine.

20. A method as recited in claim 19 wherein the second section of the pulp machine is a dryer, and wherein (e) is practiced to effect at least partial drying of the moist tail of the pulp web.

21. A method as recited in claim 19 wherein (a)–(d) are practiced at substantially the running speed of the pulp machine.

22. A method as recited in claim 19 wherein (d) is practiced so as to bring the moist tail of the pulp web into contact with the threading belt, and then to fold the threading belt over so that the moist tail of the pulp web is inside the threading belt during the practice of (e).

23. A method as recited in claim 22 wherein the second section of the pulp machine is a dryer, and wherein (e) is practiced to effect at least partial drying of the moist tail of the pulp web.

24. A method as recited in claim 19 further utilizing a transfer device comprising a frame encircled by an air pervious escort belt, and including at least one suction chamber; and wherein (c) is practiced by the suction effect provided by the suction chamber through the escort belt.

25. A method as recited in claim 24 wherein (c) is further practiced by fully supporting the moist tail of the pulp web attached to the escort belt by the suction generated by the at least one suction chamber from the support wire to the tail threading belt.

26. A method as recited in claim 24 wherein (c) and (d) are practiced by moving the escort belt at at least the surface speed of the support wire.

27. A method as recited in claim 24 wherein (c) is practiced by passing the moist tail section of the pulp web obliquely over a distance outwardly from a line of the edge of a pulp web of normal width to the tail threading belt, fully supported by the escort belt; and by causing the tail threading belt to run a short distance outwardly from the line of the edge of the pulp web of normal width.

* * * * *